US008410934B2

(12) United States Patent
Li

(10) Patent No.: US 8,410,934 B2
(45) Date of Patent: Apr. 2, 2013

(54) WARNING SYSTEM, MONITORING DEVICE AND METHOD FOR MONITORING CONTROLLED DEVICE

(75) Inventor: Shang Li, Shanghai (CN)

(73) Assignee: Inventec Appliances Corp., Taipei Hsien (TW)

( * ) Notice: Subject to any disclaimer, the term of this patent is extended or adjusted under 35 U.S.C. 154(b) by 472 days.

(21) Appl. No.: 12/786,079

(22) Filed: May 24, 2010

(65) Prior Publication Data

US 2010/0302026 A1 Dec. 2, 2010

(30) Foreign Application Priority Data

May 27, 2009 (TW) ..... 98117808 A

(51) Int. Cl.
*G08B 13/14* (2006.01)

(52) U.S. Cl. ..... 340/568.1; 340/572.1; 340/539.1

(58) Field of Classification Search ..... 340/539.1
See application file for complete search history.

(56) References Cited

U.S. PATENT DOCUMENTS

2005/0237190 A1 * 10/2005 Martell et al. ..... 340/552

* cited by examiner

*Primary Examiner* — Travis Hunnings
(74) *Attorney, Agent, or Firm* — CKC & Partners Co., Ltd.

(57) ABSTRACT

A warning system includes a monitoring device and a controlled device, wherein the controlled device includes a wireless transmitter, a wireless receiver, a phase analyzer and a warning indicator. The wireless transmitter can transmit a detection signal, and then the controlled device responses to the detection signal and transmits a feedback signal. The wireless receiver can receive the feedback signal. The phase analyzer can analyze a phase difference between the detection signal and the feedback signal. The warning indicator can perform a warning action when the phase difference is greater than a preset value. Moreover, a method for monitoring a controlled device is disclosed in specification.

17 Claims, 2 Drawing Sheets

WARNING SYSTEM, MONITORING DEVICE AND METHOD FOR MONITORING CONTROLLED DEVICE

RELATED APPLICATIONS

This application claims priority to Taiwan Application Serial Number 98117808, filed May 27, 2009, which is herein incorporated by reference.

BACKGROUND

1. Field of Invention

The present invention relates to a warning system, monitoring device and the method thereof. More particularly, the present invention relates to a warning system comprising a phase analyzer, monitoring device and the method thereof.

2. Description of Related Art

Due to rapid development in technology and consuming capacity, the variety of goods which people carry and use in daily life has been increasing. For example, the goods in most people's briefcases or bags generally might include a key case, a wallet, an integrated circuit card, a mobile phone, a digital camera, a PDA, a laptop, and other consuming electronic products. For the user, the importance of these belongings has been certainly increasing to the point where if these belongings are lost, the user may be very worried and waste a lot of time and money trying to find them. Especially, most of these goods are competitive for the small-scale design, and therefore the user may leave the goods at some place without notice, which makes the goods being lost or stolen more easily. Generally, it will be quite difficult to get these goods back, after the user finds them lost.

Consequently, the invention of warning device for preventing the goods from being stolen or lost has been enthusiastically studied and developed, and its design concept is basically based on the effective length of the signal, for example, the effective length of the Bluetooth is about 10 meters. As the distance between the goods and the user is greater than the effective distance, the device may raise the alarm. Yet, due to the interference from the actual environment, the effective distance is usually less than 10 meters, so it may induce the error alarm for not receiving the signal, which would confuse the user very much. Despite the fact that the problem mentioned above could be theoretically solved by making use of the signal whose effective length is longer, it would be no use in practical. For instance, if the signal whose effective distance is about 50 meters is applied, the alarm device only will raise as the goods is kept more than 50 meters away from the user, which is definitely not practical at all.

Therefore the present warning devices mentioned above are obviously inconvenient and imperfect and are still waiting for improvement. In order to solve the problem of error alarm, those skilled in the related art are all dedicated to thinking of an appropriate solution, but it has been a long time not seeing a suitable method to be completed. As a result, how to provide an effective alarm system and decrease the error is indeed one of the most important issues and become the ultimate goal to achieve in these relative fields.

SUMMARY

Therefore, one aspect of the present invention provides a warning system.

According to one embodiment of the present invention, a warning system includes at least one controlled device and a monitoring device, wherein the monitoring device includes a wireless transmitter, a wireless receiver, a phase analyzer and a warning indicator. When the warning system is in operation, the wireless transmitter can transmit a detection signal, which makes the controlled device transmit a feedback signal in response to the detection signal after receiving the detection signal. The wireless receiver can receive the feedback signal. The phase analyzer can analyze a phase difference between the detection signal and the feedback signal. The warning indicator can perform a warning action when the phase difference is greater than a preset phase difference.

Consequently, as the warning system is operated, the monitoring device determines whether the distance between the controlled device and the monitoring device exceeds a warning range or not, in accordance with the phase difference between the detection signal and the feedback signal. If the phase difference exceeds the preset phase difference, it means that the actual distance between the controlled device and the monitoring device has already exceeded the warning range, and then the monitoring device can perform the warning action in order to remind the holder of the monitoring device.

Another aspect of the present invention is a warning system, which is used for monitoring the controlled device.

According to another embodiment of the present invention, a monitoring device includes a wireless transmitter, a wireless receiver, a phase analyzer and a warning indicator. In operation, the wireless transmitter can transmit the detection signal, which makes the controlled device transmit a feedback signal in response to the detection signal after receiving the detection signal. The wireless receiver can receive the feedback signal. The phase analyzer can analyze the phase difference between the detection signal and the feedback signal. When the phase difference is greater than the preset phase difference, the warning indicator can perform a warning action.

As a result, when the monitoring device is used for monitoring the controlled device, the monitoring device determines whether the distance between the controlled device and the monitoring device exceeds the warning range in accordance with the phase difference between the detection signal and the feedback signal. If the phase difference exceeds the preset phase difference, it means that the actual distance between the controlled device and the monitoring device has already exceeded the warning range, and then the monitoring device can perform the warning action in order to remind the holder of the monitoring device.

The other aspect of the present invention is a method, which is used for monitoring the controlled device.

According to another embodiment of the present invention, a method used for monitoring the controlled device includes the following steps: firstly, transmitting a detection signal, which makes the controlled device transmit a feedback signal in response to the detection signal after the controlled device receives the detection signal; next, receiving the feedback signal from the controlled device, and analyze the phase difference between the detection signal and the feedback signal; last but not least, performing the warning action when the phase difference is greater than the preset value.

Consequently, as the method is applied, it is based on the phase difference between the detection signal and the feedback signal to determine whether the position of the controlled device is in the warning range or not. If the phase difference exceeds the phase difference, that means the position of the controlled device has already been out of the warning range, and therefore the method performs the warning action, such as making sounds, making vibrations or emitting lights, so as to remind the user.

These and other features, aspects, and advantages of the present invention will become better understood with reference to the following description and appended claims.

BRIEF DESCRIPTION OF THE DRAWINGS

The invention can be more fully understood by reading the following detailed description of the embodiments, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
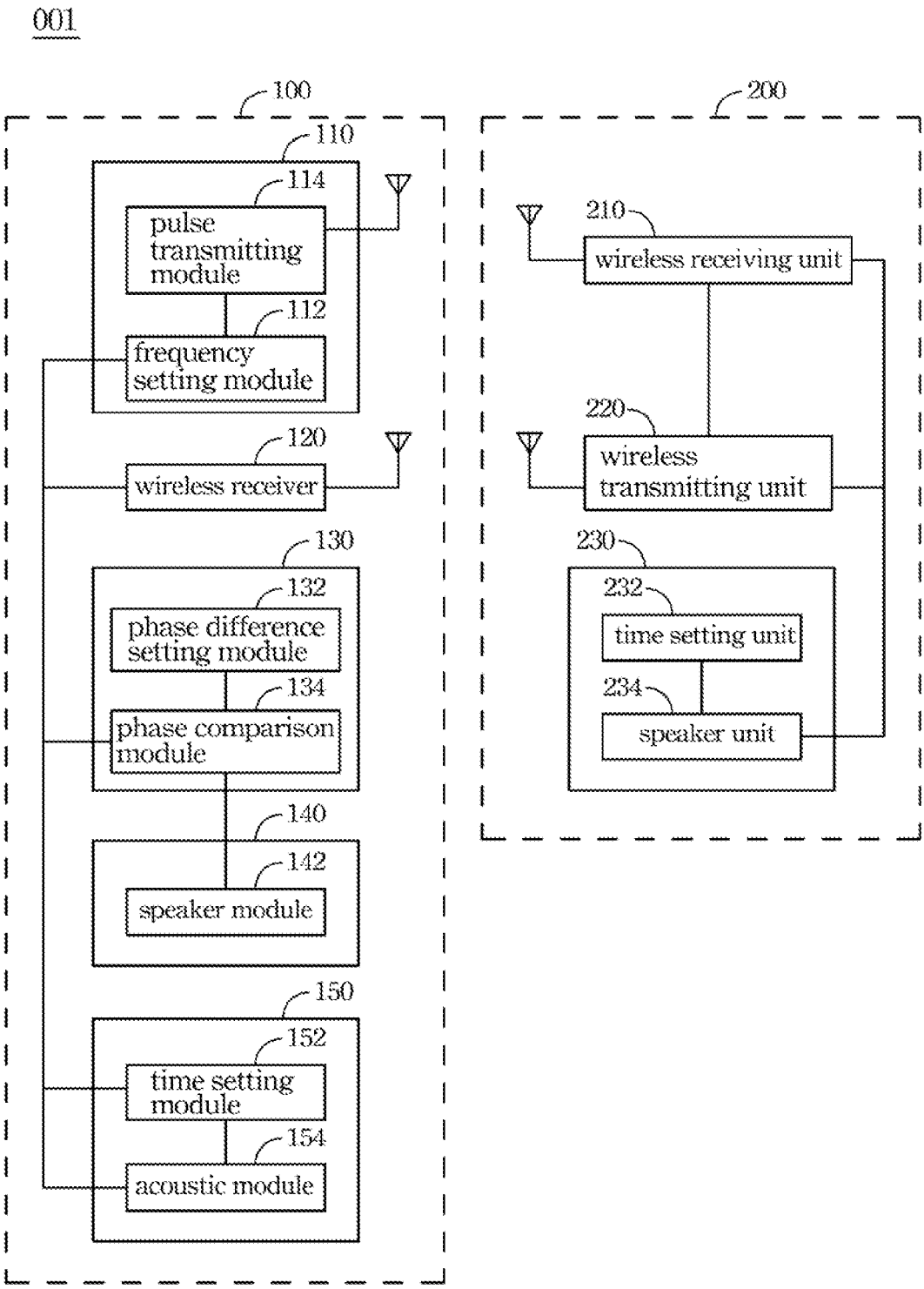
FIG. 1 is a block diagram of a warning system according to an embodiment of the present invention.

FIG. 1 is a block diagram of a warning system 001 according to an embodiment of the present invention. As shown in the FIG. 1, the warning system 001 includes a monitoring device 100 and a controlled device 200. As the warning system 001 is operated, the monitoring device 100 can detect the controlled device 200.

The monitoring device 100 includes a wireless transmitter 110, a wireless receiver 120, a phase analyzer 130 and a warning indicator 140. In operation, the wireless transmitter 110 can transmit the detection signal, which makes the controlled device 200 transmit a feedback signal in response to the detection signal after receiving the detection signal. The wireless receiver 120 can receive the feedback signal. The phase analyzer 130 can analyze the phase difference between the detection signal and the feedback signal. When the phase difference is greater than the preset phase difference, the warning indicator 140 can perform a warning action.

Consequently, the monitoring device 100 determines whether the distance to between the controlled device 200 and the monitoring device exceeds the warning range or not in accordance with the phase difference between the detection signal and the feedback signal. If the phase difference exceeds the preset phase difference, it means that the actual distance between the controlled device 200 and the monitoring device 100 has already exceeded the warning range, and then the monitoring device 100 can perform the warning action in order to remind the holder of the monitoring device 100.

In application, the monitoring device 100 can be designed into a watch with a clock function, and the controlled device 200 can also be situated in the suitcases, purses, the wallets or integrated into the mobile phone and other items which might be easily lost. Therefore, users only needs to carry monitoring device 100 to make sure whether the belongings are lost or not at any time.

Practically, the wireless transmitter 110 can transmit the wireless signal whose effective wavelength is longer in order not to be affected. The phase analyzer 130 can set the preset phase difference in accordance with the actual need to obtain the corresponding warning range. Moreover, the monitoring device 100 can be used with different signal sources, such as WIFI, 2G, 3G, etc, to detect more than one controlled device 200, which will not be limited by a one to one relationship of the present skill, such as BlueTooth.

In the present embodiment, the wireless transmitter 110 may include a frequency setting module 112 and a pulse transmitting module 114. In operation, the frequency setting module 112 can set the transmitting frequency. The pulse transmitting module 114 can transmit the impulse signal periodically in accordance with the transmitting frequency. For example, the frequency setting module 112 can set the transmitting frequency once every five seconds so that the pulse transmitting module 114 can transmit the impulse signals every five seconds.

In other embodiments, the wireless transmitter 110 can periodically transmit the sinusoidal signal or other kinds of signals recognized as the detection signal, which those skilled in the art could choose appropriately in accordance with the actual need.

The phase analyzer 130 can include a phase difference setting module 132 and a phase comparison module 134. In operation, the phase difference setting module 132 can obtain a distance parameter according to the preset phase difference mentioned above. The phase comparison module 134 can calculate how much the phase difference the feedback signal lags behind the detection signal, and then determine whether the phase difference exceeds the preset phase difference or not.

In practice, the user or the industries may input or set the related distance parameters into the monitoring device 100 according to the warning range, so as to flexibly set the warning range between the controlled device 200 and the monitoring device 100, wherein the phase difference setting module 132 can include an input interface or be electrically connected to the input interface so as to obtain the distance parameter more easily. Then, the phase difference setting module 132 will transform the distance parameter into the preset phase difference. Furthermore, the phase comparison module 134 can compare the feedback signal with the detection signal on the time axis, calculating how much phase difference the feedback signal lags behind the detection signal, and continuing to compare the result with the preset phase difference. In the comparison, the longer the distance between the controlled device 200 and the monitoring device 100 is, the more phase the feedback signal lags behind the detection signal. If the phase difference between these two signals exceeds the preset phase difference, it means that the actual distance between the controlled device 200 and the monitoring device 100 has already exceeded the warning range. On the contrary, if the phase difference doesn't exceed the preset phase difference, it means that the actual distance between the controlled device 200 and the monitoring device 100 hasn't exceeded the preset warning range described above.

In a specific embodiment of present invention, the phase difference setting module 132 and the phase comparison module 134 mentioned above can be the software program or the hardware circuit, which those skilled in the art can flexibly choose according to the actual need. Moreover, it is unnecessary to be all made up by the software or hardware; instead it could be constituted of the software and the hardware.

In the present embodiment, the warning indicator 140 can include a speaker module 142. In operation, when the phase difference between the feedback signal and the detection signal exceeds the preset phase difference described above, the speaker module 142 can perform the warning action by making sounds.

In other embodiments, the warning indicator 140 may include an eccentric motor (not shown). In operation, when the phase difference between the feedback signal and the detection signal exceeds the preset phase difference mentioned above, the eccentric motor can perform the warning action with the use of vibration. Then, the warning indicator 140 can include a light emitting device (not shown). In operation, when phase difference between the feedback signal and the detection signal exceeds the preset phase difference mentioned above, the light emitting device can perform the warning action by emitting light.

The monitoring device 100 can also include a prompter 150. In operation, after the wireless transmitter 110 transmits the detection signal, if the wireless receiver 120 hasn't received the feedback signal in the preset feedback time, the prompter 150 can perform the prompting action, so as to remind the user that the controlled device 200 hasn't make the response.

In the present embodiment, the prompter 150 may include a time setting module 152 and an acoustic module 154. In operation, the time setting module 152 can set the preset feedback time. After the wireless transmitter 110 transmits the detection signal, if the wireless receiver 120 hasn't received the feedback signal in the preset feedback time, the acoustic module 154 can make sounds, so as to perform the prompting action.

In practice, the time setting module 152 can set the preset feedback time in accordance with the transmitting frequency of the detection signal. For example, if the wireless transmitter 110 transmits a detection signal every five seconds, the time setting module 152 can set the preset detecting time to around five seconds.

In other embodiments, the prompter 150 can include an eccentric motor (not shown). In operation, after the wireless transmitter 110 transmits the detection signal, if the wireless receiver 120 hasn't received the feedback signal in the preset feedback time, the eccentric motor may vibrate so as to perform the prompting action. Otherwise, the prompter 150 may include a light emitting device (not shown). In operation, after the wireless transmitter 110 transmits the detection signal, if the wireless receiver 120 hasn't received the feedback signal in the preset feedback time, the light emitting device can emit light, so as to perform the prompting action.

In practice, the prompter 150 and the warning indicator 140 can be integrated into one device, or otherwise the prompter 150 and the warning indicator 140 can also be the individual device, which those skilled in the art may flexible choose according to the actual need.

On the other hand, the controlled device 200 can include a wireless receiving unit 210 and a wireless transmitting unit 220. As the controlled device 200 is operated, the wireless receiving unit 210 can receive the detection signal, and the wireless transmitting unit 220 can recognize the detection signal which is received by the wireless receiving unit 210 as a feedback signal, and then transmit the feedback signal.

The controlled device 200 can also include an alarm device 230. In operation, if the wireless receiving unit 210 hasn't received the detection signal in the preset detecting time, the alarm device 230 may perform the cautionary action. Therefore, if the controlled device 200 doesn't receive the detection signal, the alarm device 230 may raise alarm.

In the present embodiment, the alarm device 230 can include a time setting unit 232 and a speaker unit 234. In operation, the time setting unit 232 can set a preset detecting time. If the wireless receiving unit 210 hasn't received the detection signal in the preset detecting time, the speaker unit 234 can make sounds, so as to perform the cautionary action.

In practice, the time setting unit 232 can set the preset detecting time in accordance with the transmitting frequency of the detection signal. For example, if the monitoring device 100 transmits a detection signal every five seconds, the time setting unit 232 can set the preset detecting time to about five seconds.

In other embodiments, the alarm device 230 can include eccentric motor (not shown). In operation, if the wireless receiving unit 210 hasn't received the detection signal in the preset detecting time, the eccentric motor can make vibrations, so as to perform the cautionary action. Otherwise, the alarm device 230 can include a light emitting device (not shown). In operation, if the wireless receiving unit 210 hasn't received the detection signal in the preset detecting time, the light emitting device can emit the light, so as to perform the cautionary action.

Figure 2:
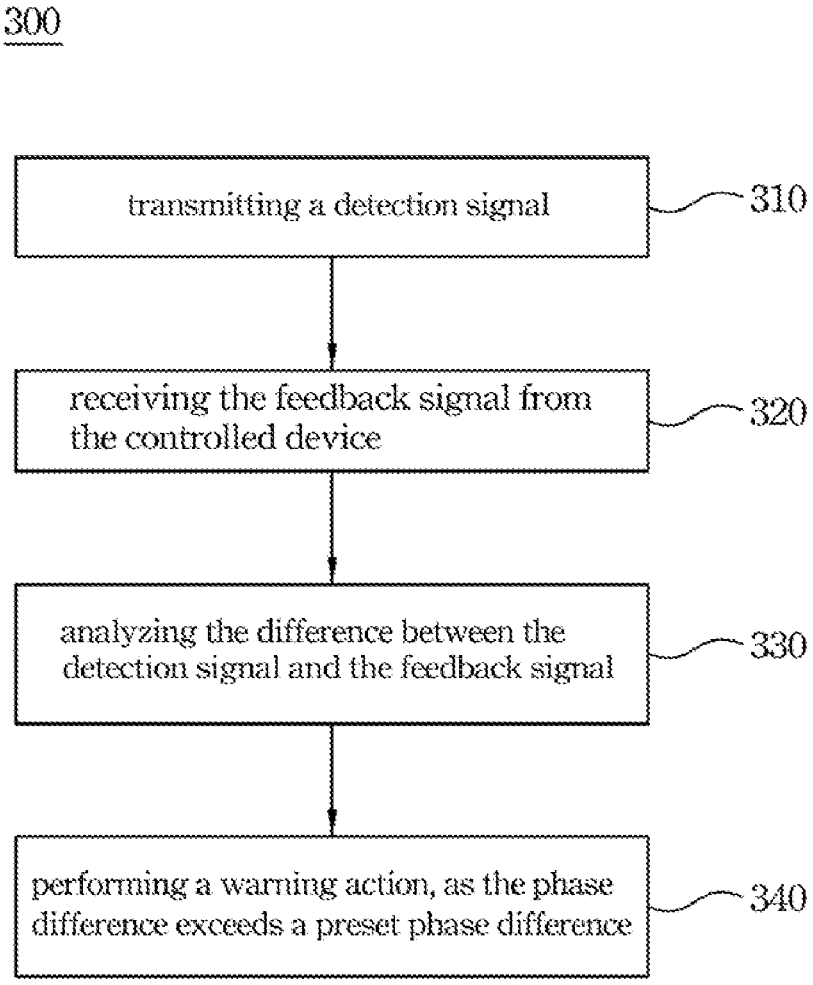
FIG. 2 is a flowchart of a method of a controlled device according to another embodiment of the present invention.

FIG. 2 is a flowchart of the method 300 of a controlled device according to another embodiment of the present invention. As shown in FIG. 2, the method 300 includes step 310, step 320, step 330 and step 340. It should be noticed that except for the steps described with the specific order, the steps in the present embodiment all could be modified, and even all or parts of the steps could be operated simultaneously. Moreover, as for the hardware in the method 300, because they have been fully disclosed, therefore it is needless to repeat again.

As shown in FIG. 2, at step 310, a detection signal could be transmitted, so as to transmit a feedback signal in response to the detection signal after the controlled device receives the detection signal. At step 320, the feedback signal can be received from the controlled device. At step 330, the phase difference between the detection signal and the feedback signal can be analyzed. At step 340, if the phase difference exceeds the preset phase difference, the warning action can be performed.

As a result, as the method 300 is used for monitoring the controlled device, it is based on the phase difference between the detection signal and the feedback signal to determine whether the position of the controlled device is in the warning range or not. If the phase difference exceeds the phase difference, that means the position of the controlled device has already been out of the warning range, and therefore the method 300 performs the warning action, such as making sounds, making vibrations or emitting lights, so as to remind the user.

At step 310, the transmitting frequency is set in accordance with the transmitting frequency, so as to periodically transmit the impulse signal in order to be recognized as the detection signal and even transmit the sinusoidal signal or other kinds of signals in order to be recognized as the detection signal, which those skilled in the art may flexibly choose according to the actual need. For example, the transmitting frequency can be set once every five seconds, and therefore; the impulse signal can be transmitted every five seconds.

In step 330, the distance parameter is obtained in accordance with the preset value, and then the phase difference between the feedback signal and the detection signal is calculated so as to determine whether or not the phase difference exceeds the preset value.

In practice, the method 300 can be used in the monitoring device or other similar devices. In order to flexibly set the warning range between the controlled device and the monitoring device, the users or industries may input or write the related distance parameter into the monitoring device in accordance with the warning range. At step 330, the distance parameter could be converted into the preset phase difference, so that the feedback signal can be compared with the detection signal on the time axial, calculating the phase that the feedback signal lags behind the detection signal, and then the result will be compared with the phase difference. The longer the distance between the controlled device and the monitoring device is, the more phase the feedback signal lags behind the detection signal. If the phase difference between these two signals exceeds the preset phase difference, it means that the actual distance between the controlled device 200 and the monitoring device 100 has already exceeded the warning range. On the contrary, if the phase difference doesn't exceed the preset phase difference, it means that the actual distance between the controlled device 200 and the monitoring device 100 hasn't exceeded the preset warning range described above.

On the other hand, in method 300, after the detection signal is transmitted, if the feedback signal hasn't been received in the preset feedback time, the prompting action can be performed, such as making sounds, making vibrations or emitting lights, so as to remind the user that the controlled device doesn't' make response. In practice, the preset feedback time can be set in accordance with the transmitting frequency of the detection signal. For example, at step 310, if the detection signal is transmitted every five seconds, the preset detecting time could be set to around five seconds.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A warning system comprising:

at least one controlled device; and a monitoring device comprising:

a wireless transmitter for transmitting a detection signal, wherein after the controlled device receives the detection signal, the controlled device responses to the detection signal and transmits a feedback signal;

a wireless receiver for receiving the feedback signal;

a phase analyzer for analyzing a phase difference between the detection signal and the feedback signal, and the phase analyzer comprising:

a phase difference setting module for obtaining a distance parameter and setting a preset phase difference in accordance with the distance parameter; and a phase comparison module for calculating the phase difference between the direction signal and the feedback signal so as to determine whether or not the phase difference is greater than the present phase difference; and a warning indicator for performing a warning action when the phase difference is greater than the preset phase difference.

2. The warning system of claim , wherein the wireless transmitter comprises:

a frequency setting module for setting a transmitting frequency; and a pulse transmitting module for periodically transmitting at least one pulse signal, which is recognized as the detection signal, in accordance with the transmitting frequency.

3. The warning system of claim 1, wherein the warning indicator comprises:

a speaker module for making sounds so as to perform the warning action when the phase difference is greater than the preset phase difference.

4. The warning system of claim 1, wherein the monitoring device comprises:

a prompter for performing a prompting action after the wireless transmitter transmits the detection signal and when the wireless receiver hasn't received the feedback signal within a preset feedback time.

5. The warning system of claim 4, wherein the prompter comprises:

a time setting module for setting the preset feedback time; and an acoustic module for making sounds so as to perform the prompting action after the wireless transmitter transmits the detection signal and the wireless receiver hasn't received the feedback signal within the preset feedback time.

6. The warning system of claim 1, wherein the controlled device comprises:

a wireless receiving unit for receiving the detection signal; and a wireless transmitting unit for recognizing the detection signal which is received by the wireless receiving unit as the feedback signal and then transmitting the feedback signal.

7. The warning system of claim 6, wherein the controlled device further comprises:

an alarm device for performing a cautionary action when the wireless receiving unit hasn't received the detection signal within a preset detecting time.

8. The warning system of claim 7, wherein the alarm device further comprises:

a time setting unit for setting the preset detecting time; and a speaker unit for making sounds so as to perform the cautionary action when the wireless receiving unit hasn't received the detection signal within the preset detecting time.

9. A monitoring device for detecting at least one controlled device, the monitoring device comprising:

a wireless transmitter for transmitting a detection signal, wherein the controlled device responses to the detection signal and transmits a feedback signal;

a wireless receiver for receiving the feedback signal;

a phase analyzer for analyzing a phase difference between the detection signal and the feedback signal, and the phase analyzer comprising:

a phase difference setting module for obtaining a distance parameter and setting a preset phase difference in accordance with the distance parameter; and a phase comparison for calculating the phase difference between the detection signal and the feedback signal so as to determine whether or not the phase difference is greater than the present phase difference; and a warning indicator for performing a warning action when the phase difference is greater than the preset phase difference.

10. The monitoring device of claim 9, wherein the wireless transmitter further comprises:

a frequency setting module for setting a transmitting frequency; and a pulse transmitting module for periodically transmitting at least one pulse signal, which is recognized as the detection signal, in accordance with the transmitting frequency.

11. The monitoring device of claim 9, wherein the warning indicator comprising:

a speaker module for making sounds so as to perform the warning action when the phase difference is greater than the preset phase difference.

12. The monitoring device of claim 9, further comprising:

a prompter for performing a prompting action after the wireless transmitter transmits the detection signal and when the wireless receiver hasn't received the feedback signal within a preset feedback time.

13. The monitoring device of claim 12, wherein the prompter comprises:

a time setting module for setting the preset feedback time; and an acoustic module for making sounds so as to perform the prompting action after the wireless transmitter transmits the detection signal and the wireless receiver hasn't received the feedback signal within the preset feedback time.

14. A method for monitoring at least one controlled device, comprising:

transmitting a detection signal, wherein the controlled device responses to the detection signal and transmits a feedback signal after receiving the detection signal;

receiving the feedback signal from the controlled device;

analyzing a phase difference between the detection signal and the feedback signal by obtaining a distance parameter and setting a preset phase difference in accordance with the distance parameter and calculating the phase difference so as to determine whether or not the phase difference is greater than the preset phase difference; and performing a warning action when the phase difference is greater than the preset phase difference.

15. The method of claim 14, wherein the step of transmitting the detection signal comprises:

setting a transmitting frequency; and periodically transmitting at least one pulse signal, which is recognized as the detection signal, in accordance with the transmitting frequency.

16. The method of claim 14, wherein the step of performing the warning action comprises making sounds.

17. The method of claim 16, further comprising:

performing a prompting action after the wireless transmitter transmits the detection signal and the wireless receiver hasn't received the feedback signal within a preset feedback time.

* * * * *